US006759993B2

(12) United States Patent
Judasz et al.

(10) Patent No.: US 6,759,993 B2
(45) Date of Patent: Jul. 6, 2004

(54) DUAL POLARIZATION ANTENNA WITH LOW SIDE LOBES

(75) Inventors: Thierry Judasz, Ramonville (FR); Jean-Francois David, Toulouse (FR); Jean-Marc Bassaler, Toulouse (FR); Jacques Maurel, Cugnaux (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/101,323

(22) Filed: Mar. 20, 2002

(65) Prior Publication Data

US 2002/0135529 A1 Sep. 26, 2002

(30) Foreign Application Priority Data

Mar. 22, 2001 (EP) ..... 01400745

(51) Int. Cl.[7] ..... H01Q 15/02
(52) U.S. Cl. ..... 343/909; 343/756; 343/781 P
(58) Field of Search ..... 343/909, 911 R, 343/912, 781 P, 753, 756, 837; H01Q 15/02

(56) References Cited

U.S. PATENT DOCUMENTS 4,062,018 A * 12/1977 Yokoi et al. ..... 343/754
4,319,250 A * 3/1982 Takano et al. ..... 343/781 CA
4,335,387 A 6/1982 Salvat et al. ..... 343/756
4,489,331 A * 12/1984 Salvat et al. ..... 343/753
4,652,891 A * 3/1987 Bossuet et al. ..... 343/909
4,665,405 A 5/1987 Drabowitch et al. ..... 343/756
5,075,680 A * 12/1991 Dabbs ..... 342/52
5,273,815 A * 12/1993 Brydon et al. ..... 442/292
5,327,149 A * 7/1994 Kuffer ..... 343/720
5,684,494 A * 11/1997 Nathrath et al. ..... 343/781 P

FOREIGN PATENT DOCUMENTS

| | | |
|---|---|---|
| EP | 0 140 199 A2 | 5/1985 |
| EP | 0 593 903 A1 | 4/1994 |
| GB | 2 182 806 A | 5/1987 |
| WO | WO 88/04480 A1 | 6/1988 |

* cited by examiner

*Primary Examiner*—Don Wong
*Assistant Examiner*—Trinh Vo Dinh
(74) *Attorney, Agent, or Firm*—Sughrue Mion, PLLC

(57) ABSTRACT

Dual polarisation antenna having low side lobes, useful in a satellite radio communication system. The antenna includes a reflector assembly (12) illuminated by a feed source (11). The reflector assembly (12) includes a front reflector (15) that reflects two electromagnetic waves orthogonally polarized and each at a different frequency, an auxiliary reflector (16) that reflects one of the orthogonally polarized electromagnetic waves, and a deflecting surface (13) that totally diffracts the orthogonally polarized electromagnetic wave that passes through the auxiliary reflector (16).

16 Claims, 3 Drawing Sheets

DUAL POLARIZATION ANTENNA WITH LOW SIDE LOBES

OBJECT OF THE INVENTION

The present invention relates to a dual polarisation antenna adapted to reflect electromagnetic waves of two orthogonal polarisations with low radiation side lobes.

The present antenna can more particularly be utilised in a satellite radiocommunication system that employs orthogonal polarisation, one polarisation being horizontal and the other vertical.

STATE OF THE ART

The technique is well known in the art, for instance in U.S. Pat. No. 4,757,323, which is incorporated herein by reference. It discloses how to manufacture a dual polarisation same-zone two-frequency antenna for telecommunications satellites. The antenna serves to focus and to direct electromagnetic energy along a communication link.

The antenna has a reflector and a source that is of the horn type. The reflector reflects two electromagnetic waves which are polarised orthogonally to each other and which are at different frequencies in such a manner as to obtain the some geographical coverage on the surface of the globe.

The central portion of the reflector, constituted by the area common to both first and second orthogonal grids, reflects both orthogonally polarised waves; whereas the peripheral portion outside the central second grid only reflects the low frequency polarised wave. The same zone coverage is obtained by determining the area and shape of the central grid in such a manner as to obtain the some zone coverage with the high frequency wave as is obtained by the first grid for the low frequency wave.

It is usually necessary to preserve a direction of polarisation of the electromagnetic energy, and to prevent the generation of both grating and side lobe components that produce interference on said desired direction of polarisation and in the rest of the satellite useful payload.

It is a disadvantage of prior art techniques that undesired grating lobes in the radiation pattern, namely in the desired direction, of an antenna are generated by antenna with many antenna elements, e.g. with several antenna elements. Further, grating lobes are undesired side lobes in the radiation pattern of an antenna.

On the other hand, wherein two reflectors are to be employed for the reflection of electromagnetic waves of differing polarisation, it is desirable to construct a single supporting structure for both reflectors, thereby conserving overall weight of the antenna. Such a sharing of support structure requires a positioning of a source such that its respective polarised electromagnetic waves impinge upon the desired reflectors for directing the waves of the respective polarisations in the desired directions.

In addition, the assembly of reflectors must be configured in a fashion such that the presence of one reflector does not interfere with the propagation of electromagnetic energy between a second reflector and the source associated therewith.

A problem arises in that constructional methods presently available for a composite antenna structure having plural reflectors entail a greater weight for the support structure than is desirable.

In brief, the prior art presents a central zone with two grids to reflect two orthogonal polarisations on different frequency, respectively, for the some coverage zone, which presents both grating and side lobes arising from the reflection of the orthogonal polarisations on the double grid. Likewise, a reflection zone formed by a single grid also favours the formation of side lobes that can have a harmful effect on the rest of the satellite useful payload.

There is therefore a need to develop a dual polorisation antenna with reduced grating and side lobes. The dual polarisation antenna has a central reflection zone for reflecting two orthogonal polarisations on different frequency and polarisation, respectively, for the same coverage zone, and a peripheral zone that reflects one polarisation and is transparent to its orthogonal polarisation. The antenna must be mounted on a single structure in order to reduce the overall weight of the assembly.

CHARACTERISATION OF THE INVENTION

To overcome the disadvantages mentioned above, the present invention provides a dual polarisation antenna with low image lobes and grating lobes, which is capable of being used in radiocommunication system.

The antenna mentioned comprises a reflector assembly illuminated by a feed source of the horn type, for example. The reflector assembly comprises a front reflector that is adopted for reflecting two orthogonally polarised electromagnetic waves and each one on a different frequency and polarisation; an auxiliary reflector that is adopted for reflecting one of the arthogonally polarised electromagnetic waves; and a deflecting surface that is adapted for diffracting the orthogonally polarised electromagnetic wave that passes through the auxiliary reflector.

The front reflector is a continuous metallic surface deposited on a supporting surface, which is capable of reflecting two orthogonal polarisations without permitting the formation of side lobes that could produce interference on the rest of the satellite useful payload and without dissipating thermal energy in the reflector. RF losses are reduced at the front reflector due to that this reflector is continuous.

The auxiliary reflector is formed by a set of uniformly spaced metallic wires, positioned to form a ring around the frontal reflector, with the purpose of permitting the reflection of the polarisation parallel to the wires, and filtering the wave polarised orthogonally thereto.

The electromagnetic wave cited is deflected by the associated deflecting surface, which deflects totally the orthogonal polarisation that traverses the auxiliary reflector into free space, permitting the formation of side lobes to be minimised.

The antenna is equipped with a single grid that simplifies its construction. The thermo-elastic behaviour of the reflector assembly is more appropriate as it admits strengthening at will.

BRIEF DESCRIPTION OF THE DRAWINGS

A more detailed explanation of the invention is given in the following description based on the attached drawings in which.

DESCRIPTION OF THE INVENTION

Figure 1:
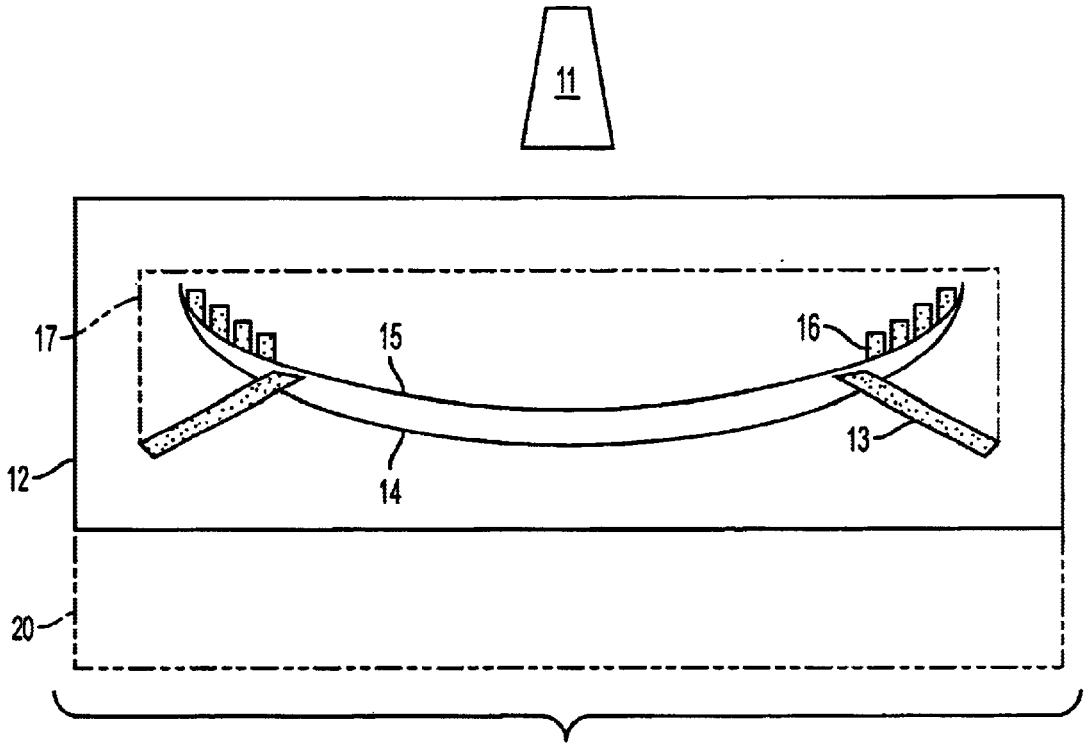
FIG. 1 shows a sectional view taken along the line AA' in FIG. 2 of an antenna according to the invention.

The antenna with dual polorisation of the invention shown in the FIG. 1 comprises a reflector assembly 12 that is illuminated by a feed horn 11 of two orthogonally polarised electromagnetic waves, that is, one wave polarised along a vertical axis and the other polarised along a horizontal axis.

The reflector assembly 12 may be mounted, for example, on a structure 20, which can be a satellite or earth station adapted for use in a radiocommunication system.

The feed horn 11 is situated opposite the lowest part (focus) of the reflector assembly 12 by means of a bracket arrangement (not shown in FIG. 1). The feed horn 11 is separated by a determined distance from the supporting surface 14. The location of the feed horn 11 permits two faces to be distinguished in the reflector assembly 12. Thus, one face, concave, is that opposite the feed horn 11, and the other face, convex, is opposite the first.

The reflector assembly 12 has a supporting surface 14, generally in the form of a parabolic, against which rests a front reflector 15, specifically on its concave face. The front reflector 15 has the mission of reflecting two orthogonally polarised electromagnetic waves and each on a different frequency, in such a manner that it is possible to cover a some geographical area on the surface of the earth's globe.

From the aforementioned, it can be deduced that in an embodiment the supporting surface 14 has a certain degree of curvature, for example it is parabolic in shape. In other embodiment, the supporting surface 14 is a flat disk, for example.

A central, circular region of the supporting surface 14 is imprinted with a continuous and conductive surface such as a metallic deposit. This region forms the front reflector 15, which is centered on the focus of the parabola. This surface 15 offers the advantage that it reflects perfectly the two orthogonally polarised waves. Therefore, the front reflector 15 prevents that image lobes will be generated and thermal dissipation is reduced. Likewise, RF parasitic radiation is reduced, which could interfere with the rest of the satellite useful payload.

Around the periphery of the front reflector 15 there is an auxiliary reflector 16 in the form of a concentric annulus abutting on the front reflector 15. The auxiliary reflector 16 is formed by a plurality of wires aligned in parallel forming a single grid reflector. The spacing between wires is chosen with the object of reflecting one of the two orthogonal polarisations, namely, the main polarisation and, therefore, is transparent to its orthogonal polarisation.

Figure 2:
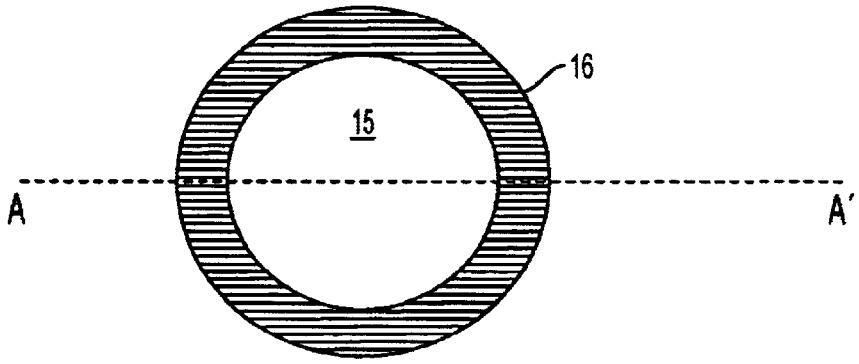
FIG. 2 shows a plan view of the antenna according to the invention.

It is desired to make the supporting surface 14 as thin as possible, consistent with sufficient rigidity for maintaining dimensional stability of the reflector assembly 12. In FIG. 2 it can be seen that the auxiliary reflector 16 is a surface concentric with the front reflector 15. The single grid reflector 16 rests on the concave face of the supporting surface 14, precisely on the zone free of front reflector 15.

The alignment of the grid ensures the filtering of one of the two orthogonal polarisations and the reflection of the pertinent desired orthogonal polorisation.

Returning now to FIG. 1, the auxiliary reflector 16 has an associated deflecting surface 13 that minimises the formation of side lobes, which are associated with the configuration of the grid 16. The deflecting surface 13 can present different shapes to improve the diffraction: for example embossed MLI may be used.

Figure 3:
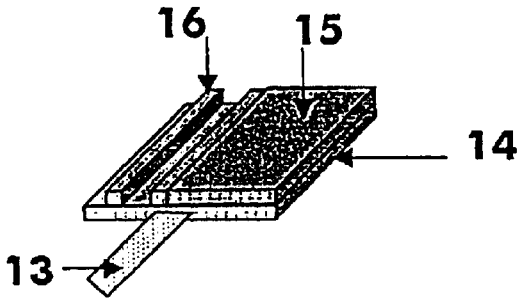
FIG. 3 shows a detail of the support assembly according to the invention.

FIG. 3 shows in detail how the deflecting surface 13 is fixed to the supporting surface 14, with the aim that the deflecting surface 13 is firmly fastened to the antenna. Thus, the deflecting surface 13 is fastened by the convex face to the supporting surface 14, underneath the separation edge that is formed by the front reflector 15 and the auxiliary reflector 16.

The disposition of the deflecting surface 13 is such that it is at an angle with respect to an axis that passes through the feed horn 11 and the focus of the supporting surface 14, with the object of making possible the dissipation of thermal energy into free space, since it reflects outwards the filtered orthogonal polarisation wave, that is, the undesired polarisation. Thus, the supporting surface 14 is transparent to the orthogonal polarisation that is deflected by means of the deflecting surface 13.

The deflecting surface 13 is contiguous with the joining edge of the front reflector 15 with the auxiliary reflector 16. Therefore the deflecting surface 13 is collocated at the rear side of the supporting surface 14 and, likewise, it is a continuous surface; that is, it is not a grid.

Returning to FIG. 3, it shows a detail of the mounting of the reflector assembly 12, specifically, the zone in which the front reflector 15 joins with the auxiliary reflector 16 and the deflecting surface 13.

Returning to FIG. 1, in the case where the reflector assembly 12 of the invention is situated on board a satellite, said assembly is protected against heat effects by a first thermal control means 17, that is, a heat shield 17 that envelopes the supporting assembly 12.

Figure 4:
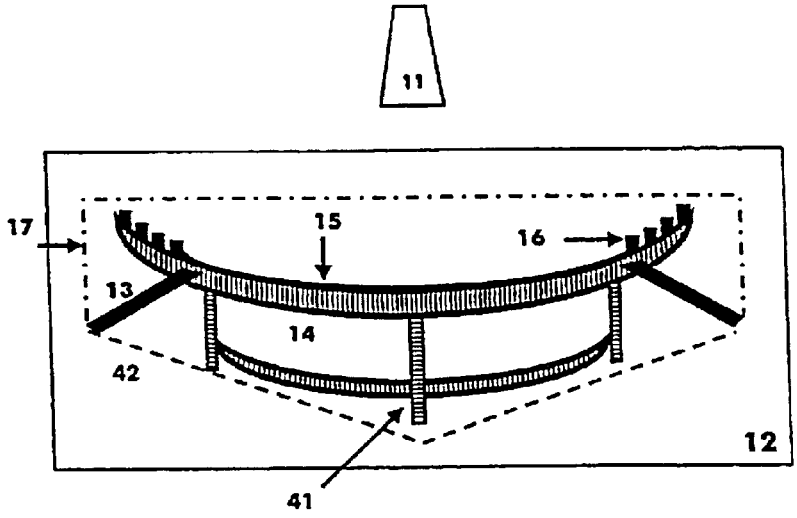
FIG. 4 shows a vertical section of a second embodiment of the antenna according to the invention.

Another embodiment of the invention is shown in FIG. 4, in which the reflector assembly 12 comprises a first mechanical supporting assembly 41, having the particular task of ensuring the stability of the reflector assembly 12.

The first mechanical supporting assembly 41 is joined to the convex face of the supporting surface 14. Likewise, the first mechanical supporting assembly 41 is enveloped by a second thermal control means 42 that provides the first mechanical supporting assembly 41 and the convex face of the supporting surface 14 with a heat shield.

Figure 5:
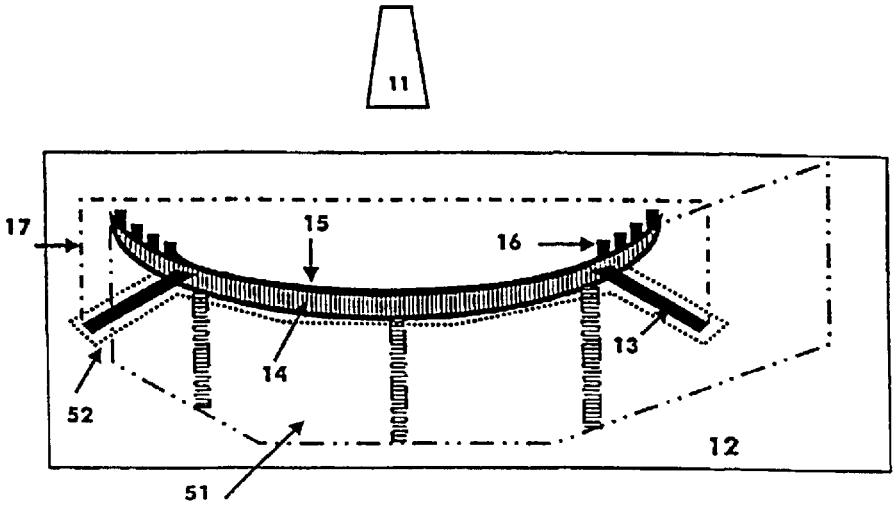
FIG. 5 shows a vertical section of a third embodiment of the antenna according to the invention.

Likewise, FIG. 5 shows a further embodiment of the invention. In this case the reflector assembly 12 comprises a second mechanical supporting assembly 51, having also the particular task of ensuring the stability of the reflector assembly 12.

The second mechanical supporting assembly 51 is also joined to the convex face of the supporting surface 14 and, in like manner, a third thermal control means 52 provides the heat shielding for the convex face of the reflector assembly 12.

The above mentioned applies to centered antenna design, feed at center of supporting surface 14, but also to offset design, in which the horn 11 is offset from the reflector assembly 12 and does not mask the wave. It is well known in the art.

The two waves could be of very close frequencies. In the latter case there is a dual polarisation antenna with the same advantages. The only difference is that it would not benefit from the some coverage for both polarisations.

In other embodiment, the feed horn 11 can include several independent horns. So, the horn set generates multibeam coverages, implying several independent feeds in the focal plane, instead of just single feed. It also applies to more complex feeds, for example BFNs (beam forming networks) instead of a single feed.

The design of the outer part of the reflector assembly 12 could be of dichroic type (frequency filter). Such design has an additional advantage, that the two waves would not be necessarily orthogonal. They can be of the same polarisation if requested by the system design.

It is to be understood that the above-described embodiments of the invention ore illustrative only, and that modifications thereof may occur to those skilled in the art. Accordingly, this invention is not to be regarded as limited to the embodiments disclosed herein, but is to be limited only as defined by the appended claims.

What is claimed is:

1. Dual polarisation antenna with reduced side lobes that comprises:

two electromagnetic waves orthogonally polarised and on a different frequency;

a feed horn (11) that emits the two electromagnetic waves; and a reflector assembly (12) illuminated by the feed horn (11) that emits the two electromagnetic waves; characterised in that the reflector assembly (12) comprises a front reflector (15) that is configured to reflect the two electromagnetic waves, an auxiliary reflector (16) that is configured to reflect one of the orthogonally polarised electromagnetic waves, and a deflecting surface (13) that is configured to diffract the orthogonally polarised electromagnetic wave that passes through the auxiliary reflector (16);

wherein the front reflector (15) is deposited on the central zone of a face of a supporting surface (14) that faces the feed horn (11) and wherein the auxiliary reflector (16) is situated around the periphery of the front reflector (15), on top of the face of the supporting surface (14) which faces the feed horn (11).

2. Dual polarisation antenna according to claim 1, characterised in that the supporting surface (14) is a surface of a parabolic type having a focal point opposite the feed horn (11).

3. Dual polarisation antenna according to claim 1, characterised in that the first reflector (15) is a continuous surface.

4. Dual polarisation antenna according to claim 1, characterised in that the auxiliary reflector (16) is formed by a set of wires aligned in parallel and spaced uniformly.

5. Dual polarisation antenna according to claim 1; characterised in that a first thermal control means (17) is adapted to enclose the reflector assembly (12).

6. Dual polarisation antenna according to claim 1; characterised in that the antenna is mounted on a satellite that is adapted for use in a radio communication system.

7. Dual polarisation antenna according to claim 1; characterised in that the antenna is mounted in earth station that is adapted for use in a radio communication system.

8. Dual polarisation antenna with reduced side lobes that comprises:

two electromagnetic waves orthogonally polarised and on a different frequency;

a feed horn (11) that emits the two electromagnetic waves; and a reflector assembly (12) illuminated by the feed horn (11) that emits the two electromagnetic waves; characterised in that the reflector assembly (12) comprise a front reflector (15) that is configured to reflect the two electromagnetic waves, an auxiliary reflector (16) that is configured to reflect one of the orthogonally polarised electromagnetic wave, and a deflecting surface (13) that is configured to diffract the orthogonally polarised electromagnetic wave that passes through the auxiliary reflector (16);

wherein the front reflector (15) is deposited on the central zone of a supporting surface (14) that faces the feed horn (11) and wherein the deflecting surface (13) is located along the separation edge that is formed by the auxiliary reflector (16) and the front reflector (15), on a face opposite to the face of the supporting (14) that faces the feed horn (11).

9. Dual polarisation antenna according to claim 8, characterised in that the deflecting surface (13) is a continuous surface.

10. A dual polarisation antenna with reduced side lobes that comprises a reflector assembly (12) illuminated by a feed horn (11); characterised in that the reflector assembly (12) comprises a front reflector (15) that is adapted in order to reflect two electromagnetic waves orthogonally polarised and on a different frequency, an auxiliary reflector (16) that is adapted in order to reflect one of the orthogonally polarised electromagnetic waves, and a deflecting surface (13) that is adapted in order to diffract the orthogonally polarised electromagnetic wave that passes through the auxiliary reflector (16);

wherein the front reflector (15) is deposited on the central zone of a face of a supporting surface (14) that faces the feed horn (11); and wherein the auxiliary reflector (16) is situated around the periphery of the front reflector (15), on top of the face of the supporting surface (14) which faces the feed horn (11).

11. The dual polarisation antenna according to claim 10, wherein the auxiliary reflector (16) is formed by a set of wires aligned in parallel and spaced uniformly.

12. A dual polarisation antenna with reduced side lobes that comprises a reflector assembly (12) illuminated by a feed horn (11); characterised in that the reflector assembly (12) comprises a front reflector (15) that is adapted in order to reflect two electromagnetic waves orthogonally polarised and on a different frequency, an auxiliary reflector (16) that is adapted in order to reflect one of the orthogonally polarised electromagnetic waves, and a deflecting surface (13) that is adapted in order to diffract the orthogonally polarised electromagnetic wave that passes through the auxiliary reflector (16);

wherein the front reflector (15) is deposited on the central zone of a face of a supporting surface (14) that faces the feed horn (11); and wherein the deflecting surface (13) is located along the separation edge that is formed by the auxiliary reflector (16) and the front reflector (15), on a face opposite to the face of the supporting surface (14) that faces the feed horn (11).

13. The dual polarisation antenna according to claim 12, wherein the deflecting surface (13) is a continuous surface.

14. A radio communication system, comprising:

two electromagnetic waves orthogonally polarised and on a different frequency;

a transmitting source that emits the two electromagnetic waves; wherein the source includes a feed horn (11);

a reflector assembly (12) illuminated by the feed horn (11) that emits the two electromagnetic waves; character ised in that the reflector assembly (12) comprises a front reflector (15) that is configured to reflect the two electromagnetic waves, an auxiliary reflector (16) that is configured to reflect one of the orthogonally polarised electromagnetic waves, and a deflecting surface (13) that is configured to diffract the orthogonally polarised electromagnetic wave that passes through the auxiliary reflector (16), wherein the front reflector (15) is deposited on the central zone of a face of a supporting surface (14) that faces the feed horn (11), and wherein the auxiliary reflector (16) is situated around the periphery of the front reflector (15), on top of the face of the supporting surface (14) which faces the feed horn (11).

15. The radio communication system of claim 14, further comprising a satellite, wherein the source and reflector assembly are mounted on the satellite.

16. The radio communication system of claim 14, further comprising an earth station, wherein the source and reflector assembly are mounted on the earth station.

* * * * *